US005305807A

United States Patent [19]

Healy

[11] Patent Number: 5,305,807

[45] Date of Patent: Apr. 26, 1994

[54] AUXILIARY VAPOR RECOVERY DEVICE FOR FUEL DISPENSING SYSTEM

[75] Inventor: James W. Healy, Hollis, N.H.

[73] Assignee: Healy Systems, Inc., Hudson, N.H.

[21] Appl. No.: 51,613

[22] Filed: Apr. 22, 1993

[51] Int. Cl.[5] ..... B65B 3/18

[52] U.S. Cl. ..... 141/59; 141/44; 141/46; 141/302; 137/587; 220/86.2

[58] Field of Search ..... 141/44, 46, 59, 302; 55/55, 387; 137/587, 589; 220/86.1, 86.2, 89.1

[56] References Cited

U.S. PATENT DOCUMENTS

| | | | |
|---|---|---|---|
| 4,095,626 | 6/1978 | Healy | 141/59 X |
| 4,197,883 | 4/1980 | Mayer | 141/59 |
| 4,256,151 | 3/1981 | Gunn | 141/59 |
| 4,306,594 | 12/1981 | Planck | 141/59 |
| 4,869,283 | 9/1989 | Oeffling et al. | 141/59 X |
| 4,872,439 | 10/1989 | Sonoda et al. | 137/588 X |
| 4,887,578 | 12/1989 | Woodcock et al. | 137/588 X |
| 4,903,672 | 2/1990 | MacKinnon | 137/587 X |
| 5,054,520 | 10/1991 | Sherwood et al. | 137/587 |
| 5,151,111 | 9/9192 | Tees et al. | 55/55 X |

OTHER PUBLICATIONS

Manos et al., "Characteristics of Activated Carbon for Controlling Gasoline Vapor Emissions-Laboratory Evaluation", SAE (Jun. 7-9, 1977).

Koehl et al., "Vehicle Onboard Control of Refueling Emissions-System Demonstration on a 1985 Vehicle", SAE (Oct. 6-9, 1986).

Clarke et al., "An Adsorption-Regeneration Approach to the Problem of Evaporative Control", SAE (1967).

*Primary Examiner*—Ernest G. Cusick

*Attorney, Agent, or Firm*—Fish & Richardson

[57] ABSTRACT

An auxiliary vapor recovery device is described for use with a fuel dispenser for delivery of fuel from tanks into a vehicle and a recovery apparatus for return of hydrocarbon vapor/air mixture displaced by fuel delivery to ullage spaces of the storage tanks interconnect by a piping manifold. The auxiliary vapor recovery device includes a vacuum pump and a canister containing a substance for removal of molecules of hydrocarbon from a vapor/air mixture. The device also has a system of conduits, including between the vacuum pump and ullage space piping system for flow to and from the ullage space, to the canister, between the vacuum pump and canister, and from the canister for release of air. The device also includes a solenoid valve system with first and second solenoid valves positioned in the conduit system, the solenoid valve system having a first (recovery) condition for permitting flow of hydrocarbon vapor/air mixture from the ullage space, through the canister for removal of hydrocarbon vapor and release of air, a second (off) condition for restricting flow of vapor in the conduit system and a third (stripping) condition for establishing an increased vacuum condition within the canister for return of hydrocarbon vapor to the ullage space. A solenoid valve system control apparatus causes the solenoid valve system to move among the first, second and third conditions.

12 Claims, 4 Drawing Sheets

AUXILIARY VAPOR RECOVERY DEVICE FOR FUEL DISPENSING SYSTEM

BACKGROUND OF THE INVENTION

The invention relates to recovery of hydrocarbon vapors from fuel storage tanks.

Vacuum-assisted Stage II vapor recovery systems serve to recover hydrocarbon vapors displaced from vehicle fuel tanks during fuel dispensing. Present systems have a tendency to return a greater volume of air and hydrocarbon vapor to the underground gasoline storage tanks than the volume of liquid gasoline dispensed to motor vehicles. This positive volumetric imbalance is partially accommodated by using pressure/-vacuum vent valves on the tank vents to allow pressure build-up within the tank ullage space without emission of hydrocarbon vapors from the tank vent, relying on condensation of the hydrocarbon vapor to relieve the pressure over time.

However, since the standard leakage test for service station ullage space permits a leakage rate of up to 0.1 cubic feet of air per minute at a positive pressure of 5-inch water column (WC), any device or system which tends to cause positive pressure will result in emission of hydrocarbon vapor through existing system leaks, e.g. at pipe joints.

SUMMARY OF THE INVENTION

According to the auxiliary vapor recovery device for use with a fuel dispensing system comprising a dispensing apparatus for delivery of fuel from a storage tank system into a vehicle tank, a recovery apparatus for return of hydrocarbon vapor/air mixture displaced by fuel delivery to ullage space of the storage tank system, a piping manifold interconnecting the ullage space of storage tanks in the storage tank system, and a vent pipe terminating in a pressure relief vent valve adapted to open when vapor pressure in the ullage space reaches a predetermined maximum level. The auxiliary vapor recovery device comprises a vacuum pump, a canister defining a volume containing a substance adapted to remove molecules of hydrocarbon from hydrocarbon vapor/air mixture flowing through the canister, a recovery device conduit system, comprising: a first conduit between the vacuum pump and a piping system from the ullage space of the fuel storage system, for flow of vapor from the ullage space into the vapor recovery device, a second conduit between the vacuum pump and the piping system from the ullage space of the fuel storage system, for flow of vapor from the vapor recovery device toward the ullage space, a third conduit for flow of vapor toward the canister, a fourth conduit between the vacuum pump and the canister for flow of vapor toward the vacuum pump, and a fifth conduit connected to the volume of the canister for release of air from the vapor recovery device, a solenoid valve system comprising a first solenoid valve and a second solenoid valve positioned in the recovery device conduit system, the solenoid valve system having a first (recovery) condition for permitting flow of hydrocarbon vapor/air mixture from the ullage space, through the canister for removal of hydrocarbon vapor and release of air, a second (off) condition for restricting flow of vapor in the recovery device conduit system and a third (stripping) condition for establishing an increased vacuum condition within the canister for return of hydrocarbon vapor to the ullage space, and a solenoid valve system control apparatus adapted to cause the solenoid valve system to move among the first condition, the second condition and the third condition.

Preferred embodiments of the invention may include one or more of the following features. The solenoid valve system control apparatus further comprises a timer to cause the solenoid valve system to assume the third condition for establishing an increased vacuum condition within the canister for return of hydrocarbon vapor to the ullage space. The first solenoid valve is positioned in the first conduit, the second solenoid valve is positioned in the second conduit, and the third conduit extends between the vacuum pump and the canister, the solenoid valve system control apparatus comprises a pressure switch positioned (preferably in connection with the first conduit) to monitor pressure in the ullage space, the solenoid valve system control apparatus being adapted to cause the solenoid valve system to move between the first condition and the second condition in response to predetermined pressure levels within the ullage space, the pressure switch, at a first predetermined pressure below the maximum pressure level, being adapted to actuate the vacuum pump and cause the solenoid valve system to assume the first (recovery) condition for permitting flow of hydrocarbon vapor/air mixture from the ullage space, through the canister for removal of hydrocarbon vapor and release of air, and the pressure switch, at a second predetermined pressure below the first predetermined pressure, being adapted to shut-off the vacuum pump and cause the solenoid valve system to assume the second (off) condition. Preferably, the first predetermined pressure is about $-\frac{1}{4}$ inch WC, and the second predetermined pressure is about $-1$ inch WC. Preferably, the device further comprises a check valve disposed in the fifth conduit for resisting flow of ambient air into the canister. The first conduit is connected to a first pipe of the piping system from the ullage space of the fuel storage system and the second conduit is connected to a second pipe of the piping system from the ullage space of the fuel storage system. The solenoid valve system further comprises a third solenoid valve positioned in the first conduit and connecting the device and a vapor return line from the dispensing apparatus, and the solenoid valve system has a fourth (fuel delivery) condition in which the third solenoid valve positioned to connect the vapor return line and the vacuum pump for primary recovery of vapor. Preferably, the third condition of the solenoid valve system and the fourth condition of the solenoid valve system are mutually exclusive. It is also preferred that the device further comprises a vacuum regulating relief valve between the first conduit and the second conduit. The first solenoid valve is positioned in the first conduit and the second solenoid valve is positioned in the fifth conduit.

Thus, according to the invention, in order to reduce the unwanted condition of hydrocarbon vapor leakage, I have designed an auxiliary vapor removal device to extract hydrocarbon vapor and expel pure air to the atmosphere, thereby reducing the ullage space pressure to slightly below atmospheric pressure and maintaining this condition so that system leaks will result in in-breathing air.

The device includes an activated charcoal canister to absorb the hydrocarbon molecules as the result of a vacuum pump discharging an air/vapor mixture withdrawn from the ullage space through the activated charcoal bed. The air component of the mixture will be discharged to the atmosphere. The pumping action is controlled by a pressure-sensing device which turns on the pump when the ullage space pressure reaches $-\frac{1}{4}$ inch WC and turn it off when the pressure is lowered to $-1$ inch WC.

The same pump is used to strip the absorbed hydrocarbons from the activated charcoal by setting a series of electrically-controlled valves to pump down the canister to nearly a full vacuum and discharge the stripped pure hydrocarbon gas back into the tank ullage space. This function is controlled by a timer and would typically run fifteen minutes in every two-hour period around the clock to periodically refresh absorption capacity.

These and other features and advantages of the invention will be seen from the following description of a presently preferred embodiment, and from the claims.

DESCRIPTION OF THE PREFERRED EMBODIMENTS

Figure 1:
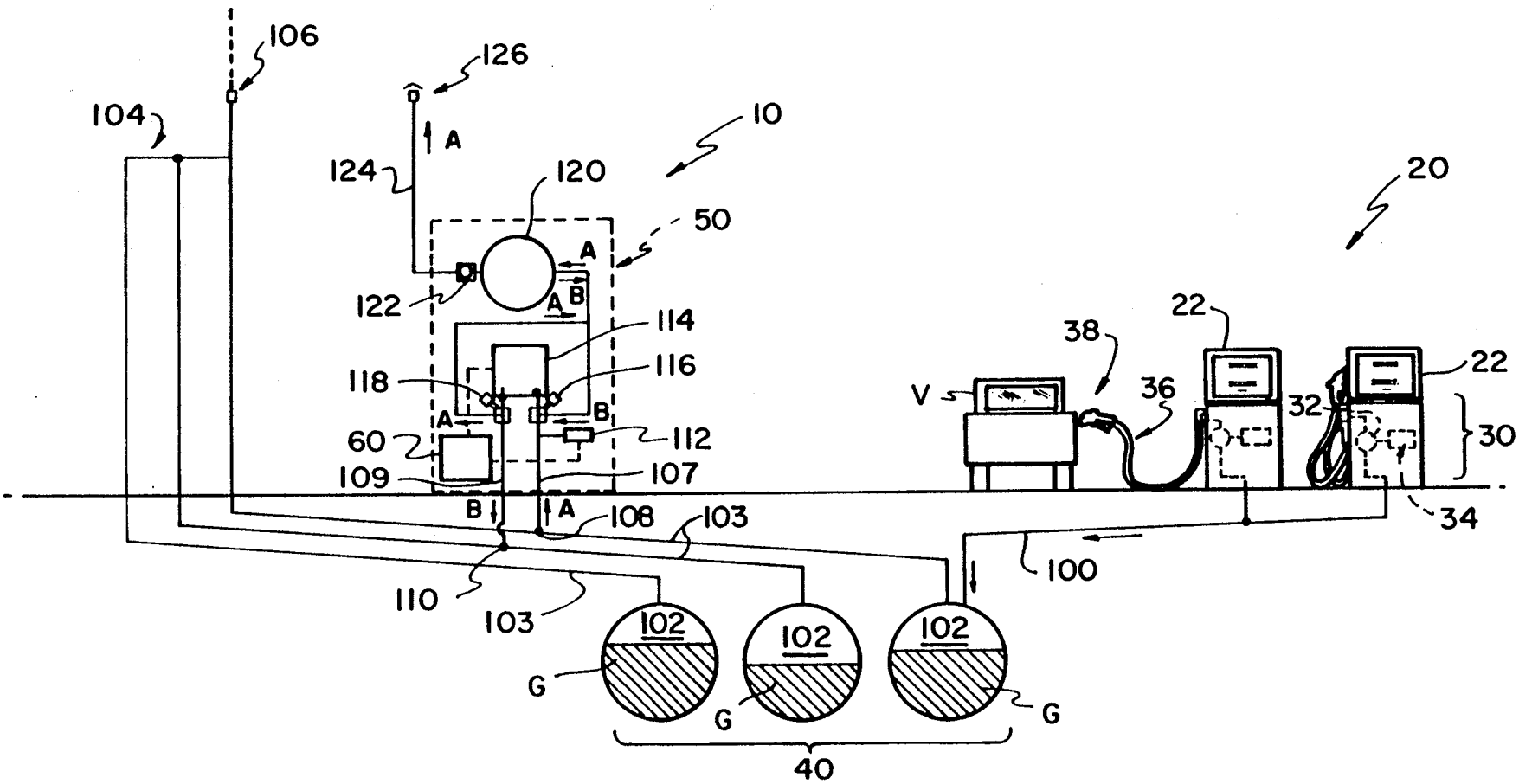
FIG. 1 is a somewhat diagrammatic view of one embodiment of an auxiliary vapor recovery device of the invention.

Referring now to FIG. 1, one embodiment of an auxiliary vapor recovery device 10 of the invention is shown in conjunction with a fuel dispenser system 20 consisting of one or more fuel dispensers 22, each equipped with a vacuum-assist Stage II vapor recovery system 30, a vacuum pump 32 and vapor flow control 34, and a coaxial hose 36 terminating in a bootless nozzle 38 for filling the fuel tank of a vehicle, V, from fuel storage tanks 40.

The gasoline vapor/air mixture recovered during the vehicle refueling process is returned through a piping network 100 to the ullage space 102 of one of the underground storage tanks 40. The excess returned volume of vapor/air returned causes pressure to increase in the tank ullage spaces 102 which are interconnected through pipes 103 by the vent pipe manifold 104. Vapors are held within the space 102 by the pressure/-vacuum vent valve 106 which prevents the release of vapor unless the pressure differential exceeds $+2$ inch WC.

The auxiliary vapor recovery device 10 is connected to piping 103 by pipe 107 at point 108 to draw off vapor-/air mixture from the ullage space 102, and also by pipe 109 at point 110 to return pure hydrocarbon gas to the ullage space 102. The vapor/air mixture is drawn off and pure hydrocarbon gas is returned at different points of piping 103 so that normal flow patterns and gravity effects will drawn the air/vapor mixture from a first tank and return the pure hydrocarbon gases to a different tank, thus reducing the possibility that the pure hydrocarbon volume stripped from the activated charcoal will be drawn back into the canister when the device 10 is in the absorption mode, as described below.

The device 10 consists of vacuum pump 114, activated charcoal canister 120 and electrical control box 60 housed within a stainless steel cabinet 50. A pressure-sensing vacuum pump actuation switch 112 monitors the pressure of the vapor/air mixture in the ullage space 102, and a pair of three-way solenoid valves 116, 118 control direction of the flow of vapor/air mixture when the vacuum pump is actuated. A spring-loaded check valve 122 permits the pure air component of the vapor-/air mixture to be expelled from the canister 120, through the vent pipe 124 and weather cap 126, into the ambient atmosphere.

Operation of the auxiliary vapor recovery device 10 will now be described.

During normal Stage II operation, with the ullage pressure between $-\frac{1}{4}$ inch WC and $-1$ inch WC, the vacuum pump 114 is off, and vapor is returned to the ullage space 102 by the vacuum-assist Stage II vapor recovery system 30.

When ullage space pressure reaches $-\frac{1}{4}$ inch WC, the pressure switch 112 actuates the vacuum pump 114 and energizes the three-way solenoid valves 116, 118 to permit the flow of vapor/air mixture in the direction shown by the arrows, A. This mode of operation draws vapor/air mixture from the ullage space 102 via connection 108 and pipe 107 and pumps the mixture into the activated charcoal canister 120. The hydrocarbon molecules are adsorbed onto the surface of the activated charcoal granules and the essentially pure air component of the mixture is expelled through the spring-loaded check valve 122, through the vent pipe 124 and weather cap 126 into the ambient atmosphere. This action continues until the pressure-sensing switch 112 causes the vacuum pump 114 to turn off, and the three-way solenoid valves 116, 118 to de-energize when the pressure reaches $-1$ inch WC. The removal of approximately 0.18% of the ullage volume (27.3 gallons from an ullage volume of 15,000 gallons) will reduce the pressure by $\frac{3}{4}$ inch WC, calculated as follows:

$$\%\ \text{Pressure Reduction} = \frac{P\ WC \times 100}{412''\ WC/\text{Atmosphere}} = \frac{0.75'' \times 100}{412} = 0.18.2\%$$

$$\text{Volume Removed} = \frac{0.182\% \times 15{,}000\ \text{Gallons}}{100} = 27.3\ \text{Gallons}$$

The activated carbon must be stripped of the hydrocarbon molecules periodically. This can be accomplished by initiating the function on a fixed time basis, e.g. run fifteen minutes every two hours, or it can be referenced to the accumulated time of vacuum pump operation in the ullage pressure reduction mode. Since the vacuum pump flow capacity and the grams of hydrocarbons per gallon of typical air/vapor mixture is known, it is possible to initiate the stripping mode when the amount of hydrocarbon adsorbed equals approximately 5% to 10% of the weight of activated charcoal used in the device.

In the stripping mode, the vacuum pump 114 is turned on, and the three-way valves 116, 118 remain de-energized to permit the flow of gases in the direction shown by the arrows, B. The vacuum pump pulls a very high vacuum, e.g. 29 inches of mercury, on the canister 120, stripping the hydrocarbon molecules from the surface of the activated charcoal granules and pumping the fuel vapor back to the underground storage tanks 40 via the vent connection 110. After applying a high vacuum for 10 to 15 minutes, the vacuum pump is shut off by a timer and the activated charcoal is refreshed for a new cycle of hydrocarbon absorption.

Figure 2:
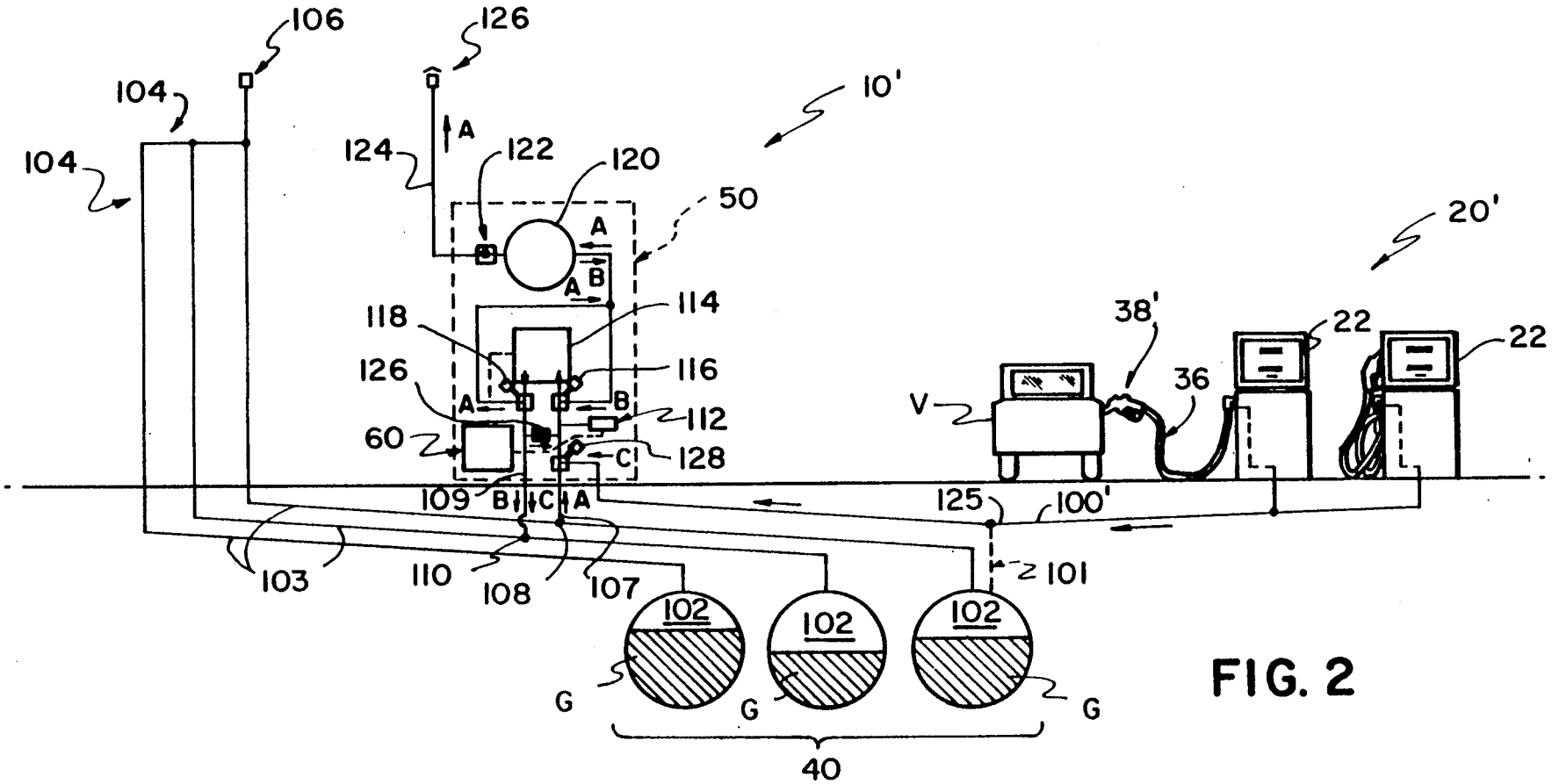
FIG. 2 is a similar view of another embodiment of an auxiliary vapor recovery device of the invention.

Referring now to FIG. 2, in another embodiment of the invention, an auxiliary vapor control device 10', similar to that described above, may be advantageously combined with a fuel dispenser system 20' employing a Healy Stage II vapor recovery system (Healy Systems, Inc. of Hudson, N.H.), as described in my co-pending patent application Ser. No. 07/706,807, filed May 29, 1991, the disclosure of which is incorporated herein by reference. In this embodiment, the vacuum pump 114 serves in the additional capacity of providing the central vacuum source for the Stage II vapor collection function by the Healy Model 600 nozzle 38' (Healy Systems, Inc.) during motor vehicle refueling.

Referring still to FIG. 2, the valve and piping arrangement to facilitate this integrated concept includes the vapor return pipe 100', which is pitched to provide a low point 125 over one of the tanks 40 so that condensate gasoline can be evacuated from the pipe 100' and returned via condensate return pipe 101 to the storage tank by means of the submerged turbine pump syphon, e.g. as described in my prior patent applications. The device 10' further includes by an additional three-way solenoid valve 128 connected to pipe 100', and a vacuum regulating relief valve 126 connected between the vacuum pump suction line 107 (connected to piping 103 at point 108) and the discharge line 109 (connected to piping 103 at point 110). The relief valve 126 provides the by-pass vapor flow necessary to maintain the −75 inch WC vacuum needed for operation of the Healy Model 600 nozzle 38'.

Under normal Stage II operating conditions, the vacuum pump 114 is turned on, and valves 116, 118, 128 are controlled electrically to permit vapor flow in the direction shown by the arrows, C. The relief valve 126 allows flow in the direction shown to maintain the required −75 inch WC of vacuum in vapor return pipe 100.

When the pressure reduction mode is required, operation will be as described earlier with respect to the embodiment of FIG. 1, and solenoid valve 128 is set to permit flow in the direction shown by the arrows, A. If vacuum for operation of nozzle 38' is required during this mode (i.e. for filling a vehicle tank), solenoid valve 128 is set for flow in the direction of the arrow, C, with all other valves remaining in the setting required for flow indicated by arrows, A. In this way, vapor from the motor vehicle refueling is directed to the charcoal canister 120, and removal of liquid gasoline, G, from the underground tank provides reduction of pressure in the ullage space 102.

The hydrocarbon stripping function as described above with respect to the embodiment of FIG. 1 will proceed only when vehicle refueling is not taking place. Stage II vapor recovery from the motor vehicle, V, will have priority over hydrocarbon stripping.

Figure 3:
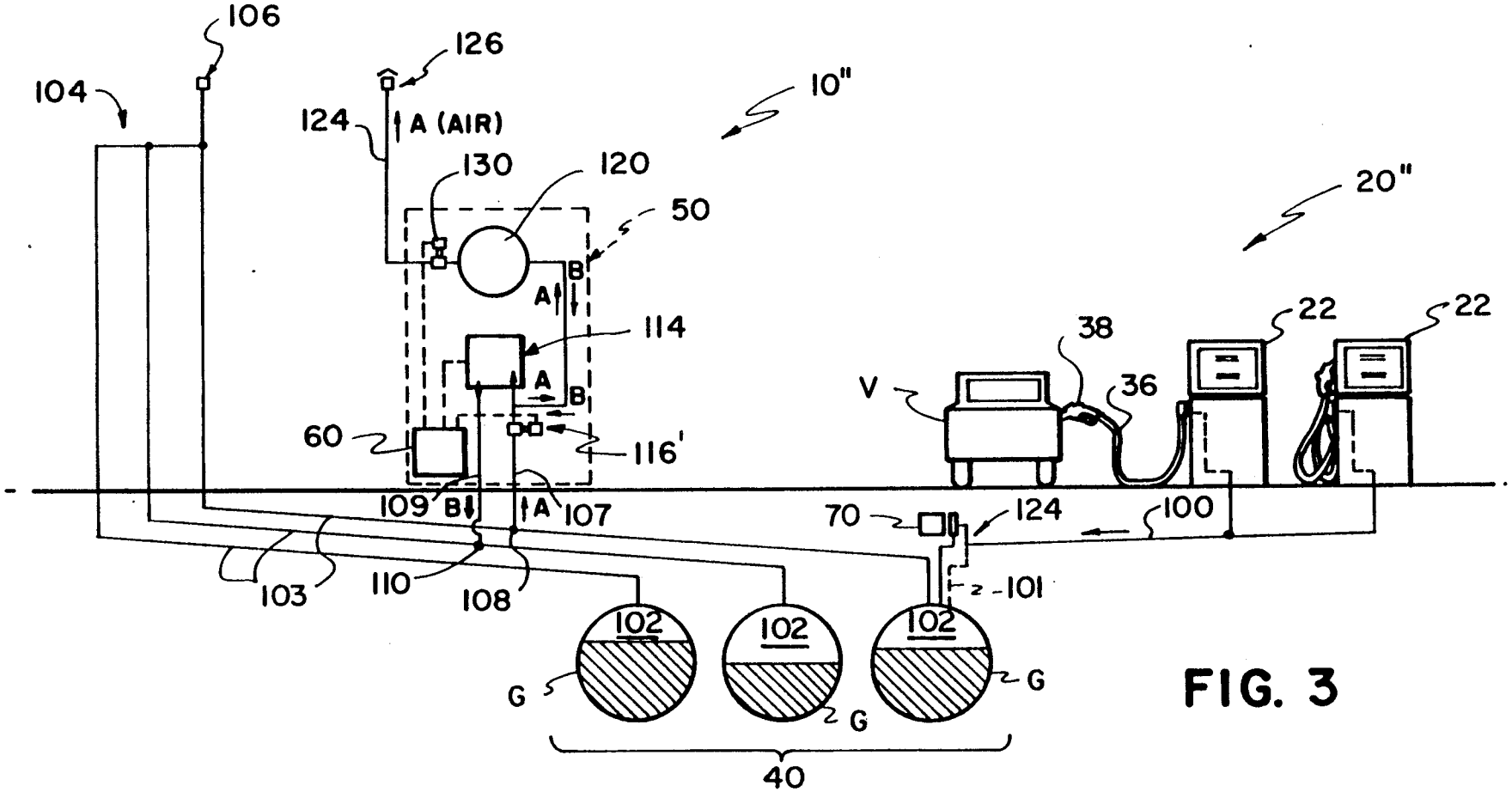
FIG. 3 is a similar view of yet another embodiment of an auxiliary vapor recovery device of the invention.

Referring now to FIG. 3, in another, slightly less-effective embodiment of the auxiliary activated carbon vapor recovery device 10'' of my invention, a second vacuum pump 70 is provided for return of vapor displaced during filling of the vehicle tank, and the high vacuum pump 114 is only employed to strip the hydrocarbon molecules from the surface of the activated carbon in canister 120 on a repeat cycle basis. For example, the vacuum pump 114 would run for a 15-minute period every two hours with a solenoid valve 116' (located in pipe 107) and a solenoid valve 130 (located in vent pipe 124, in place of the check valve of the earlier embodiment) in the closed position. Pure hydrocarbon gas would be returned to the ullage space 102 via pipe 109, connected at point 110. The essentially-pure hydrocarbon gas will migrate into a different tank 40 than the one employed for primary vapor return from the motor vehicle refueling operation. This tank, with an essentially quiet vapor space, provides an environment where the gravitational effects can take place, which commonly cause stratification of vapor/air mixture from full saturation at the liquid surface to 20% to 30% saturation at the top of the ullage space 102. This phenomenon will, therefore, have the effect of returning the gaseous hydrocarbon from the stripping function to the liquid phase over a period of time. This process is commonly referred to as "sparging".

When the pump 114 shuts down, the solenoid valves 116', 130 are opened, thus providing a flow path for the vapor/air mixture into the canister 120. In this case, flow results from the build-up of pressure in the tank ullage space 102. A pressure increase to +0.2 inch WC above atmospheric pressure would result in a flow rate of approximately 1 GPM through the piping in the direction of the arrows, A. This flow rate would accommodate processing 1,260 gallons of vapor/air mixture over a 24-hour period. Assuming a 30% excess volume of vapor, the service station could have a maximum volume of 4,200 gallons/day throughput of gasoline. Higher ullage space pressure will permit greater throughput, with the stripping cycled shortened appropriately.

Figure 4:
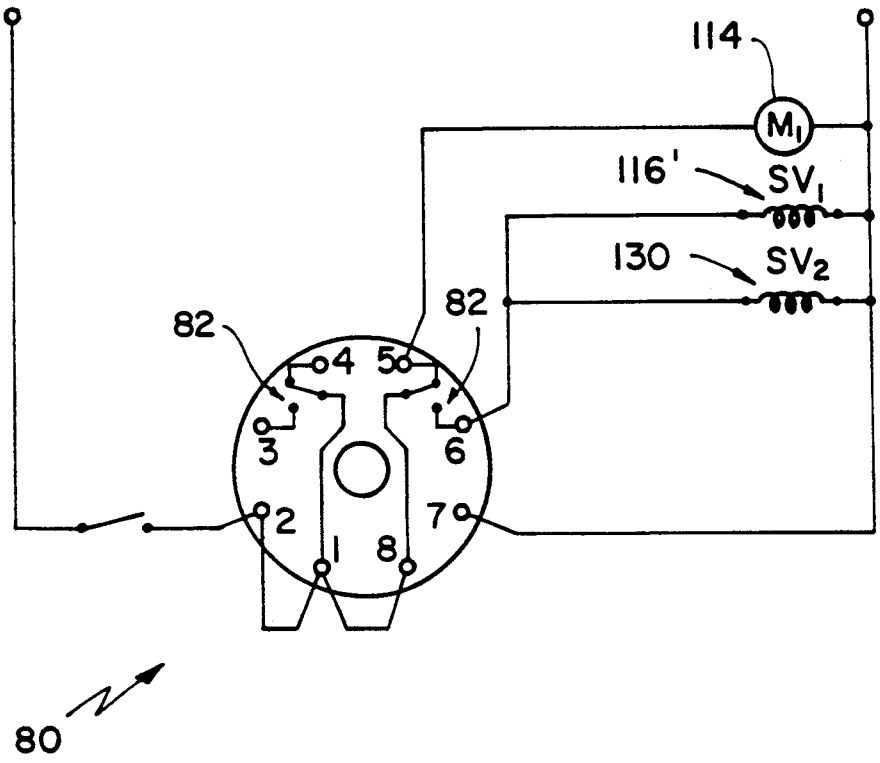
FIG. 4 is a schematic view of the electrical control diagram for the embodiment of FIG. 3.

FIG. 4 illustrates the electrical control diagram for the system shown in FIG. 3. An adjustable repeat cycle timer 80 with a double throw relay 82 energizes the vacuum pump 114 or the normally open solenoid valves 116', 130. Therefore, when the pump is actuated, the valves are closed for stripping.

Other embodiments are within the following claims. For example, in place of the automatic cycle timer, a more sophisticated hydrocarbon detector might be employed to initiate stripping when the level of hydrocarbons in the expelled air exceeds a predetermined level, e.g. 3,000 ppm.

What is claimed is:

1. An auxiliary vapor recovery device for use with a fuel dispensing system comprising a dispensing apparatus for delivery of fuel from a storage tank system into a vehicle tank, a recovery apparatus for return of hydrocarbon vapor/air mixture displaced by fuel delivery to ullage space of the storage tank system, a piping manifold interconnecting the ullage space of storage tanks in the storage tank system, and a vent pipe terminating in a pressure relief vent valve adapted to open when vapor pressure in the ullage space reaches a predetermined maximum level, said auxiliary vapor recovery device comprising a vacuum pump, a canister defining a volume containing a substance adapted to remove molecules of hydrocarbon from hydrocarbon vapor/air mixture flowing through said canister, a recovery device conduit system comprising:

a first conduit between said vacuum pump and the piping manifold from the ullage space of the fuel storage system, for flow of vapor from the ullage space into said vapor recovery device, a second conduit between said vacuum pump and the piping manifold from the ullage space of the fuel storage system, for flow of vapor from said vapor recovery device toward the ullage space, a third conduit for flow of vapor toward said canister, a fourth conduit between said vacuum pump and said canister for flow of vapor toward said vacuum pump, and a fifth conduit connected to the volume of said canister for release of air from said vapor recovery device, a solenoid valve system comprising a first solenoid valve and a second solenoid valve positioned in said recovery device conduit system, said solenoid valve system having a first, recovery condition for permitting flow of hydrocarbon vapor/air mixture from the ullage space, through said canister for removal of hydrocarbon vapor and release of air, a second, off condition for restricting flow of vapor in said recovery device conduit system and a third, stripping condition for establishing an increased vacuum condition within said canister for return of hydrocarbon vapor to the ullage space, and a solenoid valve system control apparatus adapted to cause said solenoid valve system to move among said first condition, said second condition and said third condition.

2. The auxiliary vapor recovery device of claim 1 wherein said solenoid valve system control apparatus further comprises a timer to cause said solenoid valve system to assume said third condition for establishing an increased vacuum condition within said canister for return of hydrocarbon vapor to the ullage space.

3. The auxiliary vapor recovery device of claim 1 wherein said first solenoid valve is positioned in said first conduit, said second solenoid valve is positioned in said second conduit, and said third conduit extends between said vacuum pump and said canister, said solenoid valve system control apparatus comprises a pressure switch positioned to monitor pressure in the ullage space, said solenoid valve system control apparatus being adapted to cause said solenoid valve system to move between said first condition and said second condition in response to predetermined pressure levels within the ullage space, said pressure switch, at a first predetermined pressure below the maximum pressure level, being adapted to actuate said vacuum pump and cause said solenoid valve system to assume said first, recovery condition or permitting flow of hydrocarbon vapor/air mixture from the ullage space, through said canister for removal of hydrocarbon vapor and release of air, and said pressure switch, at a second predetermined pressure below said first predetermined pressure, being adapted to shut-off said vacuum pump and cause said solenoid valve system to assume said second, off condition.

4. The auxiliary vapor recovery device of claim 3 wherein said pressure switch is connected to said first conduit.

5. The auxiliary vapor recovery device of claim 3 wherein said first predetermined pressure is about $-\frac{1}{4}$ inch WC.

6. The auxiliary vapor recovery device of claim 3 wherein said second predetermined pressure is about $-1$ inch WC.

7. The auxiliary vapor recovery device of claim 3 wherein said device further comprises a check valve disposed in said fifth conduit for resisting flow of ambient air into said canister.

8. The auxiliary vapor recovery device of claim 1 wherein the piping manifold comprises at least a first pipe and a second pipe, and wherein said first conduit is connected to the first pipe of the piping manifold from the ullage space of the fuel storage system and said second conduit is connected to the second pipe of the piping manifold from the ullage space of the fuel storage system.

9. The auxiliary vapor recovery device of claim 3 wherein said solenoid valve system further comprises a third solenoid valve positioned in said first conduit and connecting said device and a vapor return line from the dispensing apparatus, and said solenoid valve system has a fourth, fuel delivery condition in which said third solenoid valve positioned to connect the vapor return line and said vacuum pump for primary recovery of vapor.

10. The auxiliary vapor recovery device of claim 9 wherein said third condition of said solenoid valve system and said fourth condition of said solenoid valve system are mutually exclusive.

11. The auxiliary vapor recovery device of claim 9 wherein said device further comprises a vacuum regulating relief valve between said first conduit and said second conduit.

12. The auxiliary vapor recovery device of claim 1 wherein said first solenoid valve is positioned in said first conduit and said second solenoid valve is positioned in said fifth conduit.

* * * * *